US011634940B2

(12) United States Patent
Fontijn

(10) Patent No.: US 11,634,940 B2
(45) Date of Patent: Apr. 25, 2023

(54) INVISIBLE SILL—THERMALLY BROKEN

(71) Applicant: GOLDBRECHT LLC, Culver City, CA (US)

(72) Inventor: Marcel Fontijn, Culver City, CA (US)

(73) Assignee: GOLDBRECHT LLC, Culver Citv, CA (US)

( * ) Notice: Subject to any disclaimer, the term of this patent is extended or adjusted under 35 U.S.C. 154(b) by 0 days.

(21) Appl. No.: 16/951,276

(22) Filed: Nov. 18, 2020

(65) Prior Publication Data

US 2022/0154520 A1 May 19, 2022

(51) Int. Cl.

| | |
|---|---|
| ***E06B 3/263*** | (2006.01) |
| ***E06B 3/26*** | (2006.01) |
| *E06B 3/42* | (2006.01) |

(52) U.S. Cl.

CPC ..... *E06B 3/26305* (2013.01); *E06B 3/26* (2013.01); *E06B 3/42* (2013.01); *E06B 2003/26312* (2013.01)

(58) Field of Classification Search

CPC ..... E05D 15/066; E05D 15/0686; E06B 3/06; E06B 3/20; E06B 3/223; E06B 3/26301; E06B 3/14; E06B 3/42; E06B 3/46; E06B 3/4609; E06B 3/4618; E06B 3/4636; E06B 3/26347

See application file for complete search history.

(56) References Cited

U.S. PATENT DOCUMENTS

| | | | | |
|---|---|---|---|---|
| 6,202,353 | B1 * | 3/2001 | Giacomelli | E06B 3/2632 49/504 |
| 7,712,258 | B2 * | 5/2010 | Ewing | E06B 3/4636 49/410 |
| 7,987,633 | B2 * | 8/2011 | Lenox | E06B 7/205 49/504 |
| 8,578,668 | B2 | 11/2013 | Joray | |
| 8,683,747 | B2 * | 4/2014 | Kim | E06B 3/46 49/471 |
| 9,080,360 | B2 | 7/2015 | Joray | |
| 9,441,412 | B1 * | 9/2016 | Hooper, Jr. | E06B 3/263 |
| 2011/0197515 | A1 * | 8/2011 | Joray | E06B 3/4609 49/425 |
| 2012/0036810 | A1 * | 2/2012 | Joray | E06B 3/26347 52/656.5 |
| 2012/0291392 | A1 * | 11/2012 | Joray | E05D 15/0682 52/656.5 |
| 2014/0053488 | A1 * | 2/2014 | Lenox | E06B 1/36 52/404.1 |
| 2018/0179804 | A1 * | 6/2018 | Fontijn | E06B 1/52 |
| 2019/0169921 | A1 * | 6/2019 | De Sousa Guedes | E05D 15/0656 |
| 2019/0226257 | A1 * | 7/2019 | Fontijn | E05D 15/0656 |
| 2019/0383078 | A1 * | 12/2019 | Tsimbikos | E05D 15/0686 |
| 2020/0056419 | A1 * | 2/2020 | Lee | E06B 3/46 |
| 2020/0080362 | A1 * | 3/2020 | Siller | E05D 15/0686 |
| 2020/0165862 | A1 * | 5/2020 | Cohen | E06B 3/469 |
| 2020/0318419 | A1 * | 10/2020 | Guhl | E05D 15/0686 |
| 2020/0408016 | A1 * | 12/2020 | Hernandez | E05D 15/0665 |

* cited by examiner

*Primary Examiner* — Kyle J. Walraed-Sullivan
(74) *Attorney, Agent, or Firm* — Sughrue Mion, PLLC

(57) ABSTRACT

There is included an intermediate element including one or more, but not necessarily limited to, an L-shaped profiled portion configured to receive a part of a panel of a door or window, a pad configured to be fit into at least one frame part and comprising a support strip groove, and an intermediate element extended from the L-shaped portion to the pad.

20 Claims, 7 Drawing Sheets

400

500

700

INVISIBLE SILL—THERMALLY BROKEN

BACKGROUND

1. Field

The disclosed subject matter relates to framing for elements, such as sliding windows and doors having one or more panels.

2. Description of Related Art

Conventional methods and apparatuses for moving windows, doors, and other elements in a frame may include sliding and or positioning an element in and along a track. With various frames, such as a fixed frame, there may be difficulty in adequately positioning and arranging elements therein without impairing an aesthetic and without creating a tripping hazard from various protruded elements that may become misaligned due to complicated structures.

Exemplary embodiments offer solutions with respect to problems associated with the prior methods and apparatuses for positioning such elements.

SUMMARY

According to exemplary embodiments, there is one or more of an intermediate element including an L-shaped profiled portion configured to receive a part of a panel of a door or window, a pad configured to be fit into at least one frame part and comprising one of a support strip groove, and an intermediate element extended from the L-shaped portion to the pad, and wherein the intermediate element is integral with the L-shaped profiled portion and the pad.

According to exemplary embodiments, the pad and at least a first part of the intermediate element are configured to fit within the at least one frame part holding a surface such as a floor, a ceiling or a cut-out of a wall for example, and the L-shaped profiled portion and at least a second part of the intermediate element are configured to protrude from the at least one frame part and the surface, and the L-shaped profiled portion comprises a seal groove, and the intermediate element is extended from the L-shaped portion to the pad in a direction in which the seal groove is configured to receive a seal, and the L-shaped profiled portion is configured to be separated from the surface, when the pad is fit into the at least one frame part and the seal is fit into the seal groove, by the seal fit into the seal groove.

According to exemplary embodiments, there is another L-shaped profiled portion configured to receive another part of the panel and comprising another seal groove, another pad configured to be fit into at least one other frame part, and another intermediate element extended from the other L-shaped profiled portion to the other pad in a direction in which the other seal groove is configured to receive another seal which matches the direction in which the seal groove is configured to receive the seal, wherein the L-shaped profiled portion is joined to the other L-shaped profiled portion, and wherein the pad is joined to the another pad.

According to exemplary embodiments, the intermediate element and the other intermediate element are configured to extend through a same opening between the at least one frame part and the at least one other frame part when the pad is fitted to the at least one frame part and the other pad is fitted to the at least one other frame part.

According to exemplary embodiments, the other pad and at least a first part of the other intermediate element are configured to fit within the at least one other frame part holding another surface such as a floor, a ceiling or a cut-out of a wall for example, and the other L-shaped profiled portion and at least a second part of the other intermediate element are configured to protrude from the at least one other frame part and the other surface.

According to exemplary embodiments, the other L-shaped profiled portion is configured to be separated from the other surface, when the other pad is fit into the at least one other frame part and the other seal is fit into the other seal groove, by the other seal fit into the other seal groove.

According to exemplary embodiments, there is a first connector extended from a groove of the L-shaped profiled portion to another groove of the other L-shaped profiled portion, and the L-shaped profiled portion is joined to the other L-shaped profiled portion by the first connector.

According to exemplary embodiments, there is a second connector, and the first connector is extended from the L-shaped profiled portion to the other L-shaped profiled portion, and the second connector is extended from a groove of the pad to another groove of the other pad, and the pad is joined to the other pad by the second connector, and the first connector and the second connector comprise a material different than a material of the L-shaped profiled portion, and the material of the L-shaped profiled portion comprises a metal, and wherein the L-shaped profiled portion, the intermediate element, and the pad are integrally formed and comprise a metal.

According to exemplary embodiments, the first connector substantially fills a space between the intermediate element and the other intermediate element from the L-shaped profiled portion to the pad.

According to exemplary embodiments, first connector is extended through a hole in the intermediate element and a hole in the other intermediate element.

According to exemplary embodiments, the L-shaped profiled part, the intermediate element, and the pad are configured such that at least a portion of the at least one frame part is visible when the pad is fit to the at least one frame part and the part of the panel is fit to the L-shaped profiled part.

According to exemplary embodiments, there is an L-shaped profiled portion configured to receive a part of a panel of a door or window, a pad configured to be fit into at least one frame part and comprising a support strip groove, and an intermediate element extended from the L-shaped portion to the pad, another L-shaped profiled portion configured to receive another part of the panel of the door or window, another pad configured to be fit into at least one other frame part, and another intermediate element extended from the other L-shaped profiled portion to the other pad, wherein the L-shaped profiled portion is joined to the other L-shaped profiled portion, and wherein the pad is joined to the another pad.

According to exemplary embodiments, there is a first connector extended from a groove of the L-shaped profiled portion to another groove of the other L-shaped profiled portion and a second connector extended from a groove of the pad to another groove of the other pad, wherein the L-shaped profiled portion is joined to the other L-shaped profiled portion by the first connector, and wherein the pad is joined to the other pad by the second connector.

According to exemplary embodiments, the first connector and the second connector comprise a material different than a material of the L-shaped profile portion, and the material of the L-shaped profile portion comprises metal.

According to exemplary embodiments, the first connector and the second connector each comprise a thermal resistance greater than the L-shaped profile portion.

According to exemplary embodiments, the first connector substantially fills a space between the intermediate element and the other intermediate element from the L-shaped profiled portion to the pad.

According to exemplary embodiments, the first connector is extended through a hole in the intermediate element and a hole in the other intermediate element.

According to exemplary embodiments, the L-shaped profile, the intermediate element, the pad are integrally formed and comprise metal, and the other L-shaped profile portion, the other intermediate element, and the other pad are integrally formed and comprise metal.

According to exemplary embodiments, the pad and at least a first part of the intermediate element are configured to fit within the at least one frame part holding a surface such as a floor, a ceiling, or a cut-out of a wall, and the L-shaped profiled portion and at least a second part of the intermediate element are configured to protrude from the at least one frame part and the surface.

According to exemplary embodiments, the other pad and at least a first part of the other intermediate element are configured to fit within the at least one other frame part holding another surface such as a floor, a ceiling or cut-out of a wall for example, and the other L-shaped profiled portion and at least a second part of the other intermediate element are configured to protrude from the at least one other frame part and the other surface.

According to exemplary embodiments, the intermediate element and the other intermediate element are configured to extend through a same opening between the at least one frame part and the at least one other frame part when the pad is fitted to the at least one frame part and the other pad is fitted to the at least one other frame part.

According to exemplary embodiments, the L-shaped profiled part, the intermediate element, the pad, the other L-shaped profiled part, the other intermediate element, and the other pad are configured such that at least a portion of the at least one frame part and at least a portion of the at least one other frame part are visible depending on a position of the intermediate element when the pad is fit to the at least one frame part, the part of the panel is fit to the L-shaped profiled part, the other pad is fit to the at least one other frame part, and the other part of the panel is fit to the other L-shaped profiled part.

BRIEF DESCRIPTION OF THE DRAWINGS

Further features, nature, and various advantages of the disclosed subject matter will be more apparent from the following detailed description and the accompanying drawings in which.

DETAILED DESCRIPTION

Figure 1C:
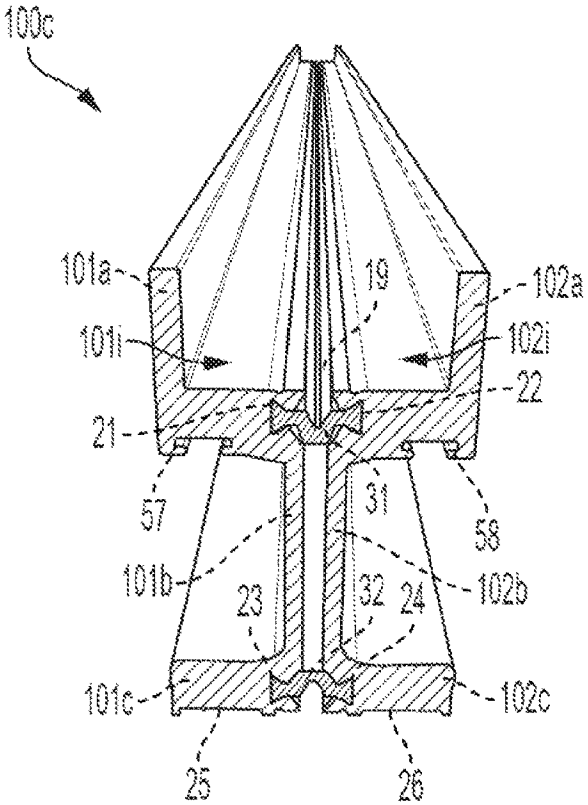
FIG. 1C is a schematic illustration of elements in accordance with exemplary embodiments.
Figure 1B:
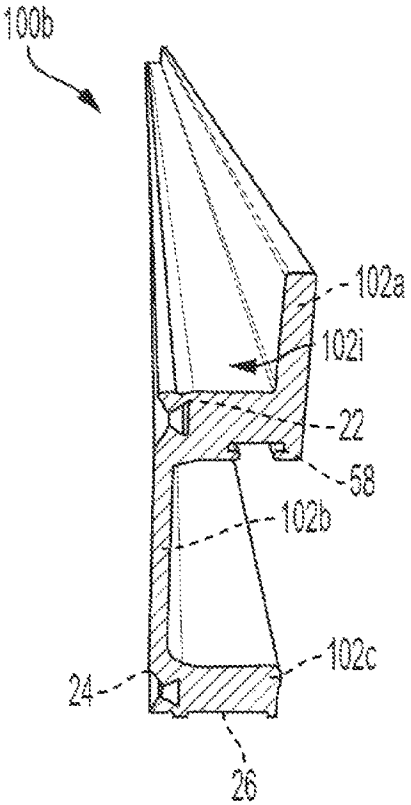
FIG. 1B is a schematic illustration of elements in accordance with exemplary embodiments.
Figure 1A:
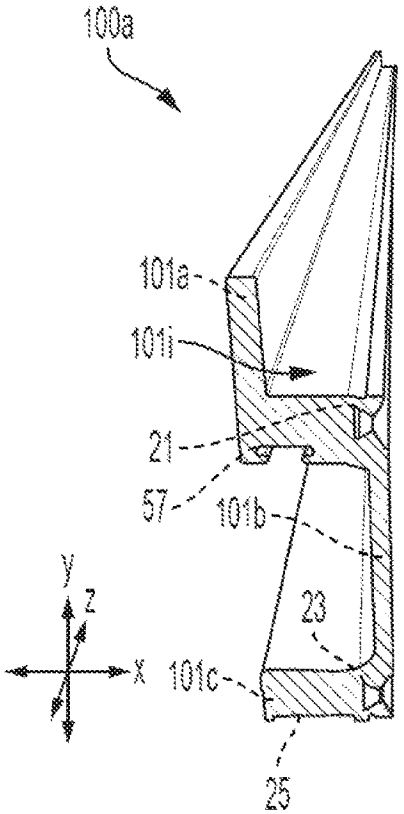
FIG. 1A is a schematic illustration of elements in accordance with exemplary embodiments.

FIG. 1A is a schematic illustration of elements in accordance with exemplary embodiments.

FIG. 1A illustrates a single piece element 100*a*, which may be referred to as an intermediate element, and which includes an L-shaped portion 101*a*, an intermediate portion 101*b*, and a pad 101*c*. The single piece element 100*a* is configured to be set into a frame, such as one or more of the frame parts 41, 42, 43, 44 and/or the surfaces 17 and 18 described further with respect to FIG. 2. The single piece element 100*a* may be made entirely of metal.

According to exemplary embodiments, the single piece element 100*a* includes various grooves, such as the grooves 21 and 23 and the grooves 57 and 25. As described with FIGS. 1C and 2, the grooves 21 and 23 may join the single piece element 100*a* to a single piece element 100*b*, of FIG. 1B, via one or more of the connectors 31 and 32. The grooves 57 and 25 will be described further with respect to FIG. 2.

Figure 2:
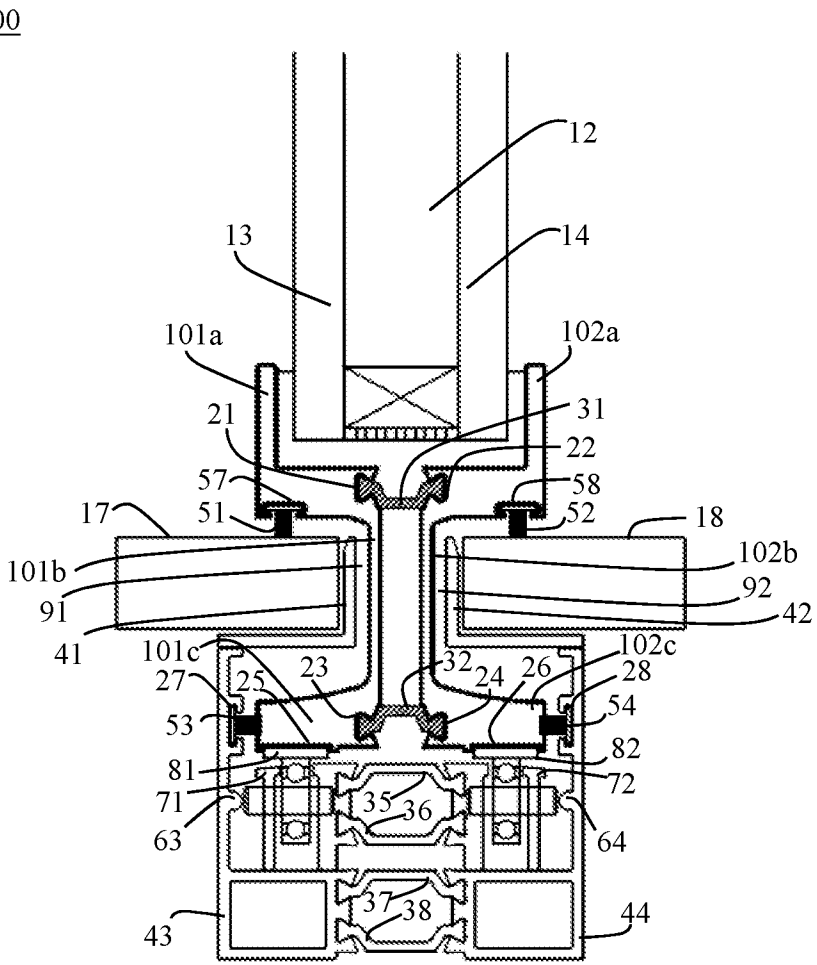
FIG. 2 is a schematic illustration of elements in accordance with exemplary embodiments.

As shown in FIG. 1A, the L-shaped portion 101*a* comprises inner surfaces 101*i* configured to receive one or more elements, such as a panel face 13, which a part of a panel, such as illustrated in FIG. 2. A bottom portion of the L-shaped portion 101*a*, in the y-direction, comprises grooves 57 which may attach to a seal 51 as in FIG. 2, where the seal 51 may be a brush or other seal according to exemplary embodiments. The L-shaped portion 101*a* also includes grooves 21, which as shown in FIGS. 1C and 2, may attach to the L-shaped portion 102*a* via a connector 31, which may be made of a non-conductive material. The grooves 21 and 57, and similarly the grooves 23 and 25, may extend longitudinally along the z-direction shown in FIG. 1A along the entire length of the single piece element 100*a*.

The L-shaped portion 101*a* in FIG. 1A is shown as attached to the pad 101*c* via an intermediate portion 101*b*, and the pad 101*c* may include one or more of the grooves 23 and 25. According to exemplary embodiments, the grooves 25 of the pad 101*c* may or may not attach to a support strip, such as a support strip 56 shown in FIG. 2. The pad 101*c* may also be attached to a seal, such as the seal 53 shown in FIG. 2, and the seal 53 may be a brush or other seal according to exemplary embodiments. The pad 101*c* also includes grooves 23, which as shown in FIGS. 1C and 2, may attach to the pad 102*c* via a connector 32, which may be made of a non-conductive material similar to the connector 31.

An end of the L-shaped portion 101*a*, away from the intermediate portion 101*b* in both the x and y-directions, is extended in the y-direction from one of the surfaces 101*i* of the L-shaped portion 101*a* where such one of the surfaces 101*i* of the L-shaped portion 101*a* is extended in the x-direction and joined to the intermediate portion 101*b*. The intermediate portion 101*b* is extended therefrom in the y-direction to the pad 101*c* which is extended away from the intermediate portion in the x and y-directions as shown in FIG. 1A. Further, the elements of the single piece element 100*a*, such as the L-shaped portion 101*a*, the intermediate portion 101*b*, the pad 101, and the grooves 21, 23, 25, and 57 may be extended in the z-direction, as shown in FIG. 1A.

FIG. 1B is a schematic illustration of elements in accordance with exemplary embodiments.

FIG. 1B illustrates a single piece element 100*b*, which may also be referred to as an intermediate element, and which includes an L-shaped portion 102*a*, an intermediate portion 102*b*, and a pad 102*c*. The single piece element 100*b* is configured to be set into a frame, such as one or more of the frame parts 41, 42, 43, 44 and/or the surfaces 17 and 18 described further with respect to FIG. 2. The single piece element 100*b* may be made entirely of metal.

According to exemplary embodiments, the single piece element 100*b* includes various grooves, such as the grooves 22 and 24 and the grooves 58 and 26. As described with FIGS. 1C and 2, the grooves 22 and 24 may join the single piece element 100*b* to a single piece element 100*a*, of FIG. 1A, via one or more of the connectors 31 and 32. The grooves 58 and 26 will be described further with respect to FIG. 2.

As shown in FIG. 1B, the L-shaped portion 102*a* comprises inner surfaces 102*i* configured to receive one or more elements, such as a panel face 14, which is another part of a panel, such as illustrated in FIG. 2. The panel faces 13 and 14 may each be parts of a single insulated glass unit (panel) that is comprises of two pieces of glass with a spacer 12 glued between them. A bottom portion of the L-shaped portion 102*b*, in the y-direction, comprises grooves 58 which may attach to a seal 52 as in FIG. 2, and the seal 52 may be a brush or other seal according to exemplary embodiments. The L-shaped portion 102*a* also includes grooves 22, which as shown in FIGS. 1C and 2, may attach to the L-shaped portion 102*a* via a connector 31, which may be made of a non-conductive material.

The L-shaped portion 102*a* in FIG. 1B is shown as attached to the pad 102*c* via an intermediate portion 102*b*, and the pad 102*c* may include one or more of the grooves 24 and 26. According to exemplary embodiments, the grooves 26 of the pad 102*c* may or may not attach to a support strip, such as a support strip 56, as shown in FIG. 2. The pad 102*c* may also be attached to a seal, such as the seal 54 shown in FIG. 2, and the seal 54 may be a brush or other seal according to exemplary embodiments. The pad 102*c* also includes grooves 24, which as shown in FIGS. 1C and 2, may attach to the pad 101*c* via a connector 32, which may be made of a non-conductive material similar to the connector 31. The grooves 22 and 58, and similarly the grooves 24 and 26, may extend longitudinally along the Z-direction shown in FIG. 1A along the entire length of the single piece element 100*b*.

An end of the L-shaped portion 102*a*, away from the intermediate portion 102*b* in both the x and y-directions, is extended in the y-direction from one of the surfaces 102*i* of the L-shaped portion 102*a* where such one of the surfaces 102*i* of the L-shaped portion 102*a* is extended in the x-direction and joined to the intermediate portion 102*b*. The intermediate portion 102*b* is extended therefrom in the y-direction to the pad 102*c* which is extended away from the intermediate portion in the x and y-directions as shown in FIG. 1B. Further, the elements of the single piece element 100*b*, such as the L-shaped portion 102*a*, the intermediate portion 102*b*, the pad 102, and the grooves 22, 24, 26, and 58 may be extended in the z-direction, as shown in FIG. 1B.

FIG. 1C is a schematic illustration of elements in accordance with exemplary embodiments.

FIG. 1C illustrates an element 100*c*, which may also be referred to as an intermediate element, and which, according to exemplary embodiments, includes the single piece element 100*a* joined to the single piece element 100*b* of FIGS. 1A and 1B via the connectors 31 and 32 which may be made of a non-conductive material. The L-shaped portions 101*a* and 102*a*, the intermediate elements 101*b* and 102*b*, the pads 101*c* and 102*c*, the grooves 21 and 22, the grooves 57 and 58, the grooves 23 and 24, and the grooves 25 and 26 may be mirrored and bilaterally symmetric as illustrated in FIG. 1C. Further, the extension 19 of the connector 31 is shown in FIG. 1C as extended between the single piece elements 100*a* and 100*b* in the z-direction, and the connector 32 may similarly be extended.

As in FIG. 1C, and similarly as in FIG. 2, the L-shaped portions 101*a* and 102*a* each symmetrically extend away from an x-direction center of the element 100*c* through which the connectors 31 and 32 are shown extended between the areas having the L-shaped portions 101*a* and 102*a*, the intermediate elements 101*b* and 102*b*, and the pads 101*c* and 102*c*. According to exemplary embodiments, an area between the intermediate elements 101*b* and 102*b* in the x-direction may be hollow.

The L-shaped portion 101*a*, the intermediate element 101*b*, and the pad 101*c* may be made of a same metal and may be integrally formed, and the other L-shaped portion 102*a*, the other intermediate element 102*b*, and the other pad 102*c* may be made of the same metal and maybe integrally formed. The connectors 31 and 32 may be made of different materials than the metal of the single piece element 100*a* and the single piece element 110*b* and may have a greater thermal resistivity than any of the portions of the single piece element 100*a* and the single piece element 110*b*. Further, the single piece element 100*a*, the single piece element 110*b*, and the element 100*c* when fitted into the frame parts as shown and described with respect to FIG. 2, are configured such that at least part of the frame parts remain visible from the surface such as a floor, a ceiling or cut-out of a wall for example.

FIG. 2 is a schematic illustration of elements in accordance with exemplary embodiments.

FIG. 2 illustrates connections 200 representing exemplary embodiments, which may involve an invisible sill, in which the element 100*c*, such as shown in FIG. 1C, is attached to various elements, such as the panel faces 13 and 14 of a panel which may be a sliding window, the seals 51 and 52, the seals 53 and 54 and support strips 81 and 82. Although the elements shown in FIG. 2 are illustrated in cross-section of the above-noted x and y-directions, the elements extend in the above-noted z-direction as well according to embodiments.

The inner surfaces of the L-shaped portions 101*a* and 102*a* are illustrated in FIG. 2 as holding panel faces 13 and 14 of the panel therebetween. The L-shaped portions 101*a* and 102*a* are also shown as raised above the surfaces 17 and 18 and the frame parts 41, 42, 43, and 44 such that at least portions of the surfaces 17 and 18 and the frame parts 41 and 42 may or may not be partly visible but are not obscured by the element 100*c* described with respect to FIG. 1C. The frame parts 41, 42, 43, and 44 represent portions of a fixed frame. The surfaces 17 and 18 may be any of a floor, a ceiling, or a cut-out of a wall, and portions of a raised or indented platform for example. The L-shaped portions 101*a* and 102*a* may be raised from the surfaces 17 and 18 by respective ones of the seals 51 and 52 which connect to lower portions of the L-shaped portions 101*a* and 102*a* and the support strips 57 and 58 along tracks respectively.

As shown in FIG. 2, the intermediate elements 101*b* and 102*b* are at least partly extended from above the surfaces 17 and 18 from the L-shaped portions 101*a* and 102*a* through openings 91 and 92, which form a same passage between the frame parts 41 and 42 through to below, in the y-direction, the surfaces 17 and 18 to the pads 101*c* and 102*c*. The frame parts 41 and 42 may comprise extensions holding the surfaces 17 and 18 therebetween as shown in FIG. 2, and the frame parts 41 and 42 similarly may be attached to the frame parts 43 and 44 by one or more of flexible projections which may connect to ones of projection ribs if any.

FIG. 2 illustrates that outer portions of the pads 101*c* and 102*c* are connected to seals 53 and 54 which are connected into grooves 27 and 28 of inner surfaces of the frame parts 43 and 44. Further, the bottom portions of the pads 101*c* and 102*c* may be seated on the intermediate element portions 71 and 72 by at least one support strips 57 and 58, and the intermediate element portions 71 and 72 may include actuation elements, such as rolling features, held in place by at least one or more ribs 63 and 64 shown in FIG. 2 as part of an inner surface of the frame parts 43 and 44.

Lower portions of the frame parts 43 and 44 and also portions of the intermediate element portions 71 and 72 may be connected by means of connectors, such as elements 35, 36, 37, and 38 which may be alternate arrangements of elements such as the connects 31 and 32 described herein. Any of the connectors 35, 36, 37, and 38 and connectors 31 and 32 may be made of a non-conductive material and thereby may act as thermal breaks between one or more portions to which those connectors may be connected so as to resist thermal energy transfer between those portions while maintaining connection there between.

Figure 3:
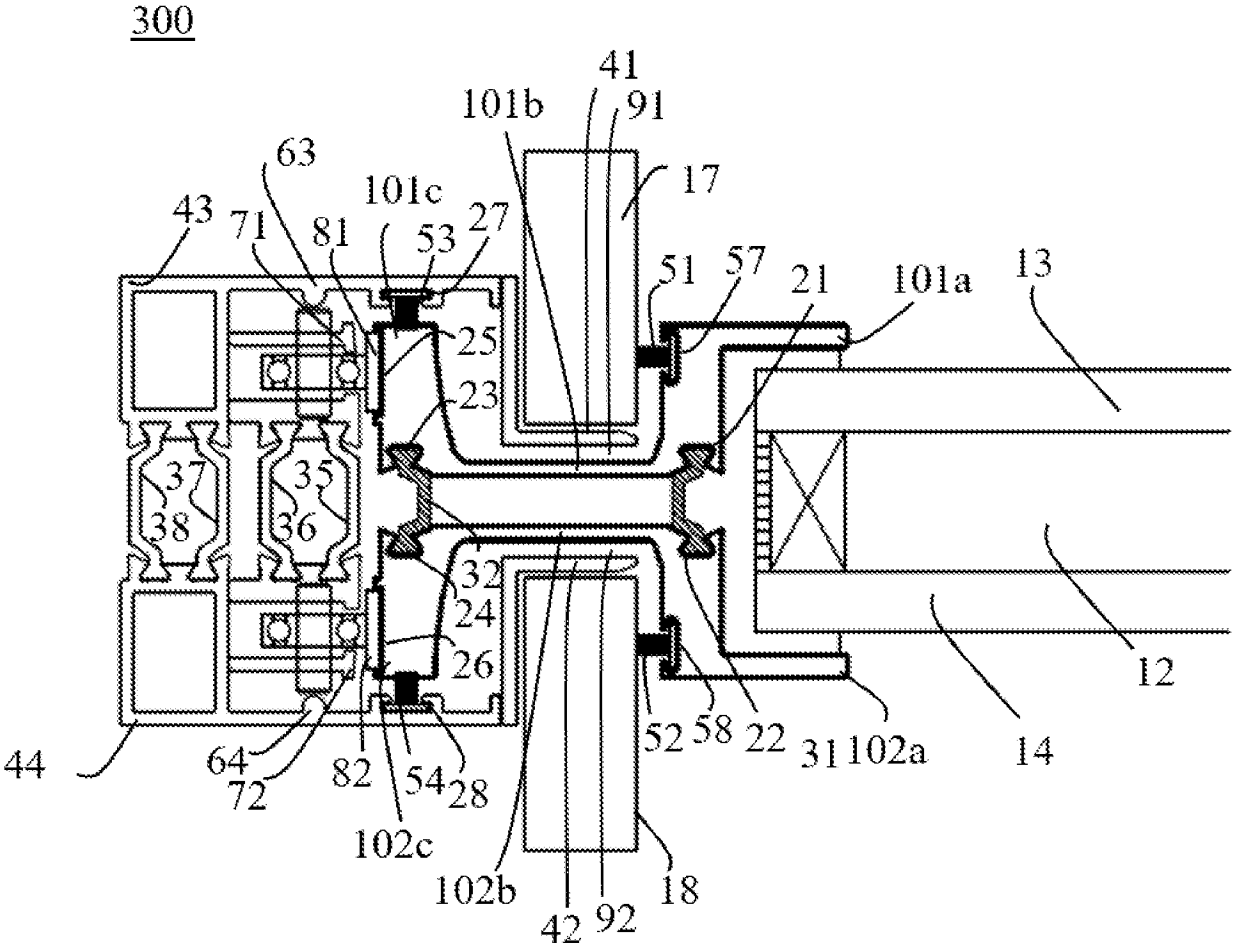
FIG. 3 is a schematic illustration of elements in accordance with exemplary embodiments.

FIG. 3 is a schematic illustration of elements in accordance with exemplary embodiments.

FIG. 3 illustrates connections 300 representing one or more exemplary embodiments including those elements shown and described with respect to FIG. 2 but also turned horizontally so as to run up a wall such as for a guillotine window, and may involve an invisible sill, in which the element 100*c*, such as shown in FIG. 1C, is attached to various elements, such as the panel faces 13 and 14 of a panel which may be a sliding window, the seals 51 and 52, the seals 53 and 54 and support strips 57 and 58 along tracks. Although the elements shown in FIG. 3 are illustrated in cross-section of the above-noted x and y-directions, the elements extend in the above-noted z-direction as well according to embodiments.

The inner surfaces of the L-shaped portions 101*a* and 102*a* are illustrated in FIG. 3 as holding panel faces 13 and 14 of the panel therebetween. The L-shaped portions 101*a* and 102*a* are also shown as extended beyond the surfaces 17 and 18 and the frame parts 41, 42, 43, and 44 such that at least portions of the surfaces 17 and 18 and the frame parts 41 and 42 may or may not be visible but are not obscured by the element 100*c* described with respect to FIG. 1C. According to exemplary embodiments, frame parts 41 and 42 may or may not be visible depending on whether other ones of the illustrated portions are slid into closed or open positions. For example, frame parts 41 and 42 may be visible in an open position and not visible in a closed position, and the surfaces 17 and 18 may be visible in both open and closed positions. The open and closed positions may depend on whether a window, described further below, is slid open or closed. The frame parts 41, 42, 43, and 44 represent portions of a fixed frame. The surfaces 17 and 18 may be any of a floor, a ceiling, a cut-out of a wall, and portions of a raised or indented platform for example. The L-shaped portions 101*a* and 102*a* may be extended from the surfaces 17 and 18 by respective ones of the seals 51 and 52 which connect to portions of the L-shaped portions 101*a* and 102*a* at the grooves 57 and 58 respectively.

As shown in FIG. 3, the intermediate elements 101*b* and 102*b* are at least extended from above the surfaces 17 and 18 from the L-shaped portions 101*a* and 102*a* through openings 91 and 92, which form a same passage between the frame parts 41 and 42 through to below, in the y-direction, the surfaces 17 and 18 to the pads 101*c* and 102*c*. The frame parts 41 and 42 may comprise extensions holding the surfaces 17 and 18 therebetween as shown in FIG. 3, and the frame parts 41 and 42 similarly may be attached to the frame parts 43 and 44 by one or more of flexible projections which may connect to ones of projection ribs, if any.

FIG. 3 illustrates that outer portions of the pads 101*c* and 102*c* are connected to seals 53 and 54 which are connected into grooves 27 and 28 of inner surfaces of the frame parts 43 and 44. Further, the bottom portions of the pads 101*c* and 102*c* may be seated on the intermediate element portions 71 and 72 by at least one support strip 81 and 82, and the intermediate element portions 71 and 72 may include actuation elements, such as rolling features, held in place by at least one or more ribs 63 and 64 shown in FIG. 2 as part of an inner surface of the frame parts 43 and 44.

Lower portions of the frame parts 43 and 44 and also portions of the intermediate element portions 71 and 72 may be connected by means of connectors, such as elements 35, 36, 37, and 38 which may be alternate arrangements of elements such as the connects 31 and 32 described herein. Any of the connectors 35, 36, 37, and 38 and connectors 31 and 32 may be made of a non-conductive material and thereby may act as thermal breaks between one or more portions to which those connectors may be connected so as to resist thermal energy transfer between those portions while maintaining connection there between.

The terminology used between elements in FIGS. 2 and 3 are used similarly for consistency; however, as noted above, it will be understood that FIG. 3 represents various embodiments in which those elements of FIG. 2 may be turned horizontally so as to, for example, run up a wall such as in a guillotine window.

Exemplary embodiments of modification will be described with respect to FIGS. 4, 5, 6, and 7 and are interchangeable with embodiments described above with respect to FIGS. 1A, 1B, 1C, 2, and 3 for advantageous effects depending on various situations as would be understood by one of ordinary skill in the art from view of the present disclosure.

Figure 4:
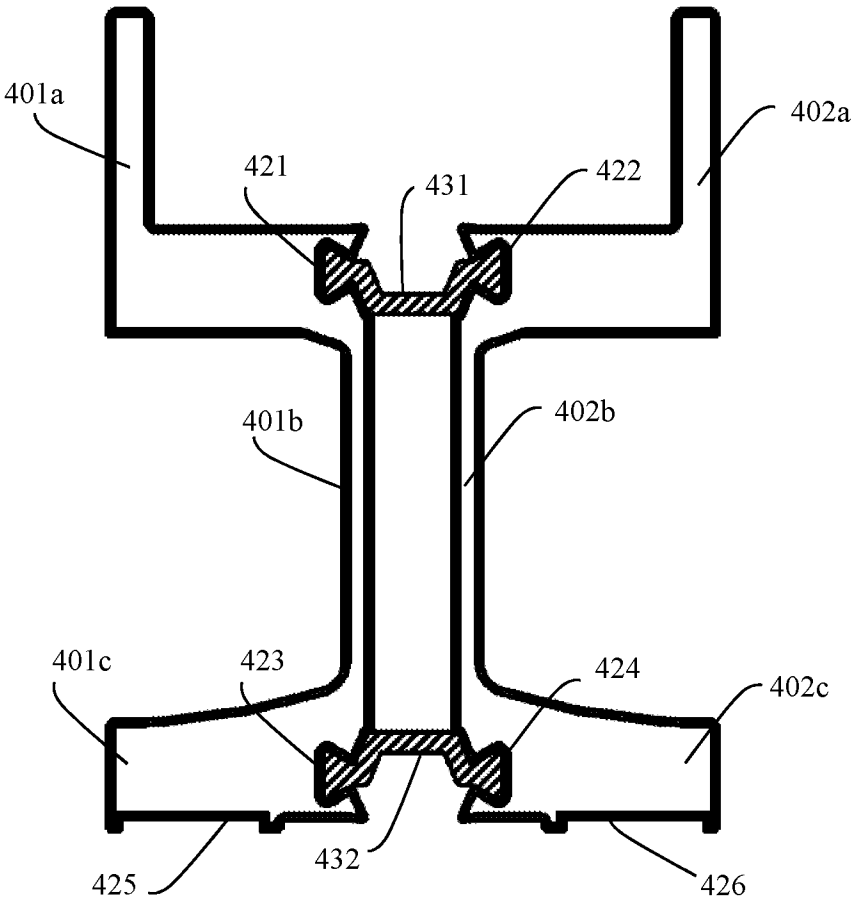
FIG. 4 is a schematic illustration of elements in accordance with exemplary embodiments.

FIG. 4 is a schematic illustration of elements in accordance with exemplary embodiments. As compared with one or more other embodiments, embodiments of FIG. 4 may not have a seal included at the L-shaped portions 401*a* and 402*a*.

FIG. 4 illustrates an element 400, which may also be referred to as an intermediate element, and which, according to exemplary embodiments, includes a single piece element joined to another single piece element, like with the single piece element 100*a* joined to the single piece element 100*b* of FIGS. 1A and 1B, via the connectors 431 and 432 which may be made of a non-conductive material. The single piece elements include L-shaped portions 401*a* and 402*a*, the intermediate elements 401*b* and 402*b*, the pads 401*c* and 102*c*, the grooves 421 and 422, the grooves 423 and 424, and the grooves 425 and 426 may be mirrored and bilaterally symmetric as illustrated in FIG. 4. Further, the extension 19 of the connector 31 is shown in FIG. 1C as extended between the single piece elements 100*a* and 100*b* in the z-direction, and such connector 32 may similarly be extended with respect to the elements shown in FIG. 4 according to embodiments.

As in FIG. 4, and similarly as in FIG. 2, the L-shaped portions 401*a* and 402*a* each symmetrically extend away from an x-direction center through which the connectors 431 and 432 are shown extended between the areas having the L-shaped portions 401*a* and 402*a*, the intermediate elements 401*b* and 402*b*, and the pads 401*c* and 402*c*. According to exemplary embodiments, an area between the intermediate elements 401*b* and 402*b* in the x-direction may be hollow.

The L-shaped portion 401*a*, the intermediate element 401*b*, and the pad 401*c* may be made of a same metal and may be integrally formed, and the other L-shaped portion 402*a*, the other intermediate element 402*b*, and the other pad 402*c* may be made of the same metal and maybe integrally formed. The connectors 431 and 432 may be made of different materials than the metal of the single piece elements and may have a greater thermal resistivity than any of the portions of the single piece elements. Further, the single piece elements when fitted into the frame parts as shown and described with respect to FIG. 2, are configured such that at least part of the frame parts remain visible from the surface, such as the floor, the ceiling or the cut-out of to wall for example, according to exemplary embodiments including those of FIG. 4.

Figure 5:
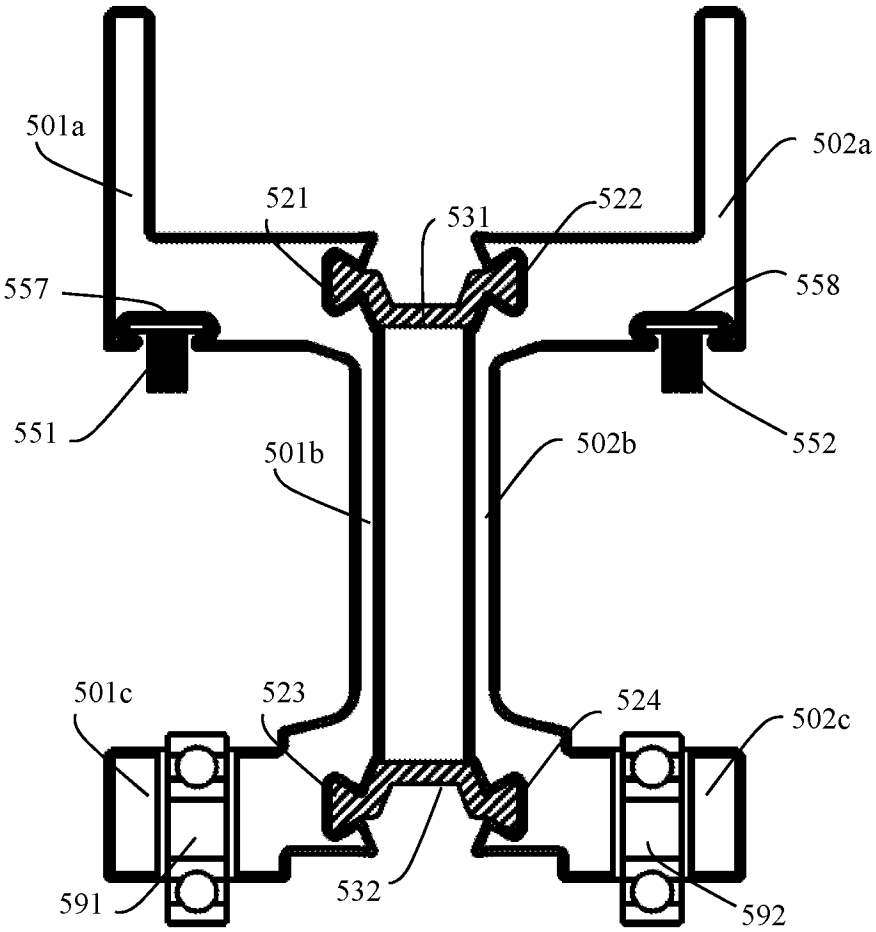
FIG. 5 is a schematic illustration of elements in accordance with exemplary embodiments.

FIG. 5 is a schematic illustration of elements in accordance with exemplary embodiments. As compared with other embodiments, embodiments of FIG. 5 may include roller bearings 591 and 592 mounted on the pads 501*c* and 502*c* instead of necessarily using one or more of the tracks described above.

FIG. 5 illustrates an element 500, which may also be referred to as an intermediate element, and which, according to exemplary embodiments, includes a single piece element joined to another single piece element, like with the single piece element 100*a* joined to the single piece element 100*b* of FIGS. 1A and 1B, via the connectors 531 and 532 which may be made of a non-conductive material. The single piece elements include L-shaped portions 501*a* and 502*a*, the intermediate elements 501*b* and 502*b*, the pads 501*c* and 502*c*, the grooves 557 and 558 with illustrated seals 551 and 552, and the grooves 523 and 524, may be mirrored and bilaterally symmetric as illustrated in FIG. 5, and the seals 551 and 552 may be brushes or other seals according to exemplary embodiments. Further, the extension 19 of the connector 31 is shown in FIG. 1C as extended between the single piece elements 100*a* and 100*b* in the z-direction, and the connector 32 may similarly be extended with respect to the elements shown in FIG. 5 according to embodiments.

As in FIG. 5, and similarly as in FIG. 2, the L-shaped portions 501*a* and 502*a* each symmetrically extend away from an x-direction center through which the connectors 531 and 532 are shown extended between the areas having the L-shaped portions 501*a* and 502*a*, the intermediate elements 501*b* and 502*b*, and the pads 501*c* and 502*c*. According to exemplary embodiments, an area between the intermediate elements 501*b* and 502*b* in the x-direction may be hollow.

The L-shaped portion 501*a*, the intermediate element 501*b*, and the pad 501*c* may be made of a same metal and may be integrally formed, and the other L-shaped portion 502*a*, the other intermediate element 502*b*, and the other pad 502*c* may be made of the same metal and maybe integrally formed. The connectors 531 and 532 may be made of different materials than the metal of the single piece elements and may have a greater thermal resistivity than any of the portions of the single piece elements. Further, the single piece elements when fitted into the frame parts as shown and described with respect to FIG. 2, are configured such that at least part of the frame parts remain visible from the surface, such as the floor, the ceiling or the cut-out of the wall for example, according to exemplary embodiments including those of FIG. 5.

Figure 6:
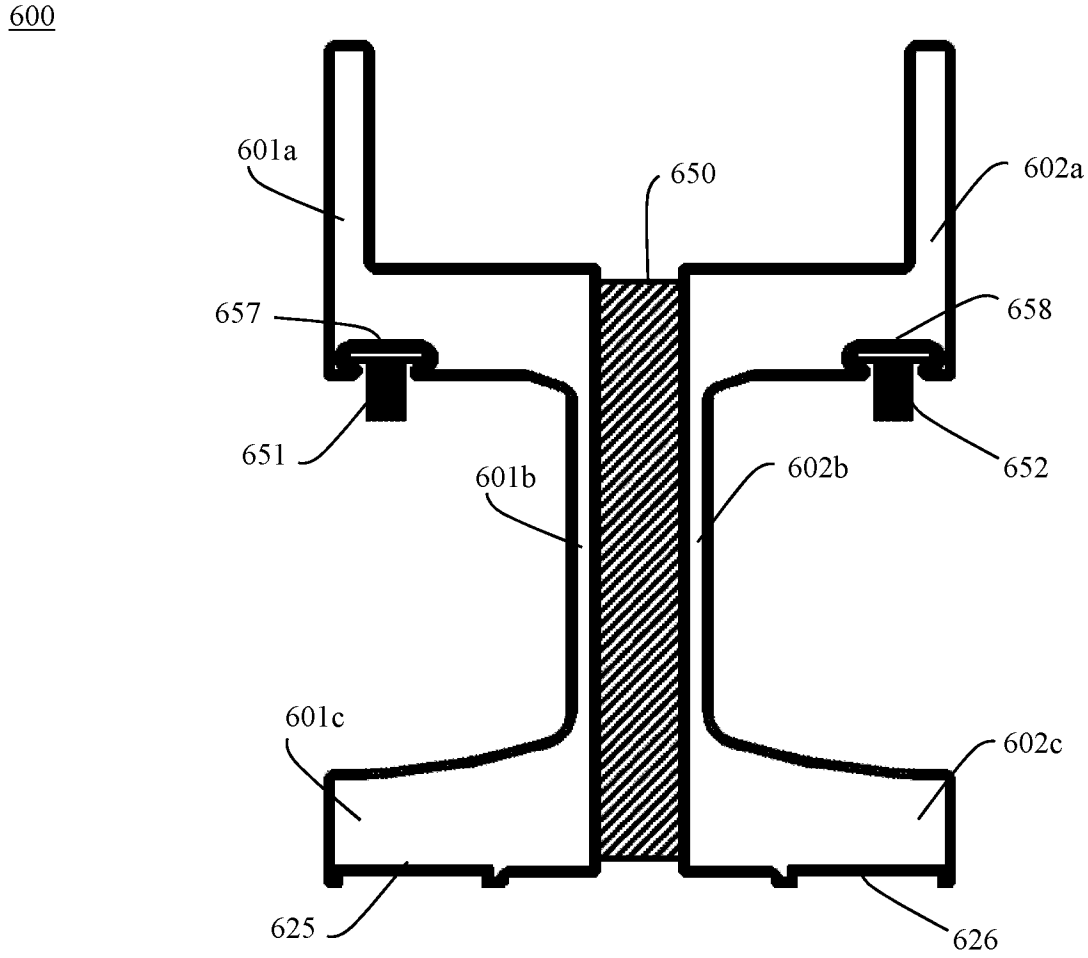
FIG. 6 is a schematic illustration of elements in accordance with exemplary embodiments.

FIG. 6 is a schematic illustration of elements in accordance with exemplary embodiments. As compared with other embodiments, embodiments of FIG. 6 may include a thermal connector 650 as a pour-in or bonded version described further below.

FIG. 6 illustrates an element 600, which may also be referred to as an intermediate element, and which, according to exemplary embodiments, includes a single piece element joined to another single piece element, like with the single piece element 100*a* joined to the single piece element 100*b* of FIGS. 1A and 1B, via a thermal connector 650 which may be a pour-in or bonded version adhering the intermediate elements shown in FIG. 6 and may be made of a non-conductive material. The single piece elements include L-shaped portions 601*a* and 602*a*, the intermediate elements 601*b* and 602*b*, the pads 601*c* and 602*c*, the grooves 657 and 658 with illustrated seals 651 and 652 (or without those seals where the seals 651 and 652 may be brushes or other seals according to exemplary embodiments), and the grooves 625 and 626 may be mirrored and bilaterally symmetric as illustrated in FIG. 6. Further, the extension 19 of the connector 31 is shown in FIG. 1C as extended between the single piece elements 100*a* and 100*b* in the z-direction, and the connector 650 may similarly be extended with respect to the elements shown in FIG. 6 according to embodiments.

As in FIG. 6, and similarly as in FIG. 2, the L-shaped portions 601*a* and 602*a* each symmetrically extend away from an x-direction center through which the connector 650 is shown extended between the areas having the L-shaped portions 601*a* and 602*a*, the intermediate elements 601*b* and 602*b*, and the pads 601*c* and 602*c*. According to exemplary embodiments, an area between the intermediate elements 601*b* and 602*b* in the x-direction may be partly hollow or substantially filled with the connector 650.

The L-shaped portion 601*a*, the intermediate element 601*b*, and the pad 601*c* may be made of a same metal and may be integrally formed, and the other L-shaped portion 602*a*, the other intermediate element 602*b*, and the other pad 602*c* may be made of the same metal and maybe integrally formed. The connector 650 may be made of one or more of different materials than the metal of the single piece elements and may have a greater thermal resistivity than any of the portions of the single piece elements. Further, the single piece elements when fitted into the frame parts as shown and described with respect to FIG. 2, are configured such that at least part of the frame parts remain visible from the surface, such as the floor, the ceiling or the cut-out of the wall for example, according to exemplary embodiments including those of FIG. 6.

Figure 7:
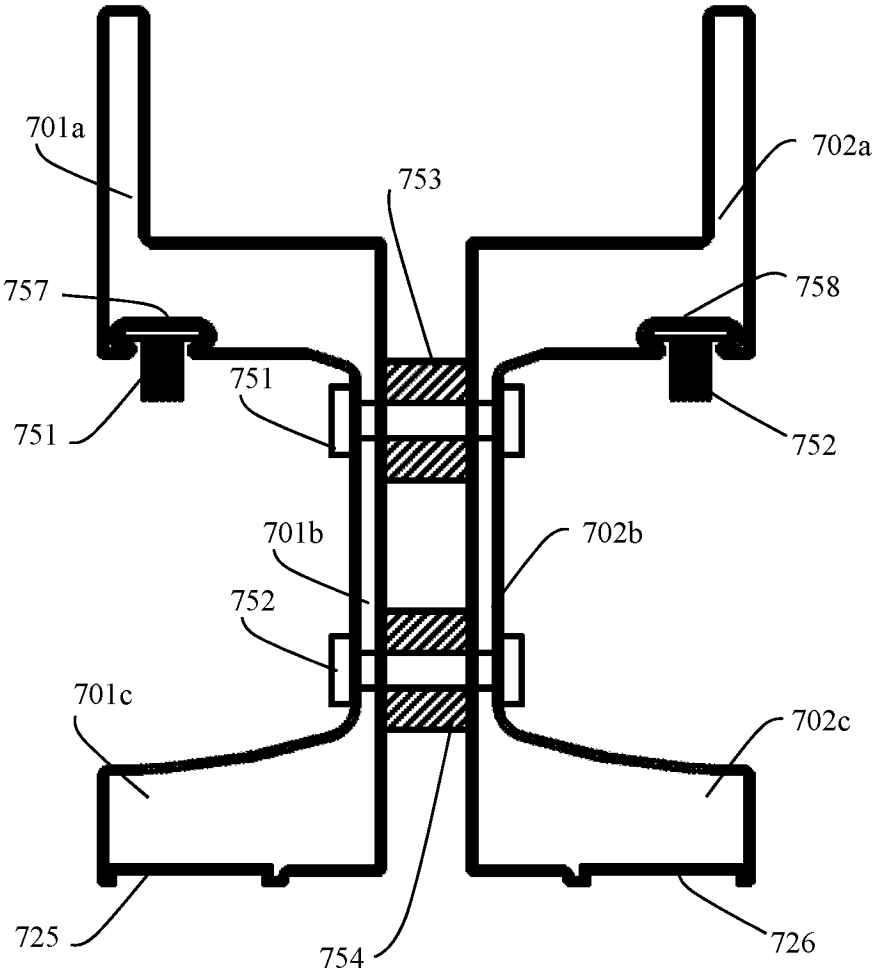
FIG. 7 is a schematic illustration of elements in accordance with exemplary embodiments.

FIG. 7 is a schematic illustration of elements in accordance with exemplary embodiments. As compared with other embodiments, embodiments of FIG. 7 may include thermal connectors 751, 753 and 752, 754 as fasteners and spacers described further below.

FIG. 7 illustrates an element 700, which may also be referred to as an intermediate element, and which, according to exemplary embodiments, includes a single piece element joined to another single piece element, like with the single piece element 100*a* joined to the single piece element 100*b* of FIGS. 1A and 1B, via the connectors 751, 753 and 752, 754 which may be made of a non-conductive material as a fastener and spacer version in contrast to other exemplary embodiments. The single piece elements include L-shaped portions 701*a* and 702*a*, the intermediate elements 701*b* and

702*b*, the pads 701*c* and 702*c*, openings through which the connectors 751 and 752 pass through the intermediate elements 701*b* and 702*b*, the grooves 757 and 758 with illustrated seals 751 and 752 (or without those seals where the seals may be brushes or other seals according to exemplary embodiments), and the grooves 725 and 726 may be mirrored and bilaterally symmetric may be mirrored and bilaterally symmetric as illustrated in FIG. 7. Further, the extension 19 of the connector 31 is shown in FIG. 1C as extended between the single piece elements 100*a* and 100*b* in the z-direction, and the plurality of connectors 751, 753 and 752, 754, such as in sequence along the z-direction, may similarly be extended with respect to the elements shown in FIG. 7 according to exemplary embodiments.

As in FIG. 7, and similarly as in FIG. 2, the L-shaped portions 701*a* and 702*a* each symmetrically extend away from an x-direction center through which the connectors 751,752, 753, and 754 are shown extended between the areas having the L-shaped portions 701*a* and 702*a*, the intermediate elements 701*b* and 702*b*, and the pads 701*c* and 702*c*. According to exemplary embodiments, an area between the intermediate elements 701*b* and 702*b* in the x-direction may be hollow.

The L-shaped portion 701*a*, the intermediate element 701*b*, and the pad 701*c* may be made of a same metal and may be integrally formed, and the other L-shaped portion 702*a*, the other intermediate element 702*b*, and the other pad 702*c* may be made of the same metal and maybe integrally formed. The plurality of connectors 751, 753 and 752, 754 between may be made of different materials than the metal of the single piece elements and may have a greater thermal resistivity than any of the portions of the single piece elements. Further, the single piece elements when fitted into the frame parts as shown and described with respect to FIG. 2, are configured such that at least part of the frame parts remain visible from the surface, such as the floor, the ceiling or the cut-out of the wall for example, according to exemplary embodiments including those of FIG. 7.

While this disclosure has described several exemplary embodiments, there are alterations, permutations, and various substitute equivalents, which fall within the scope of the disclosure. It will thus be appreciated that those skilled in the art will be able to devise numerous systems and methods which, although not explicitly shown or described herein, embody the principles of the disclosure and are thus within the spirit and scope thereof.

What is claimed is:

1. An intermediate element comprising:

a first intermediate member and a second intermediate member, each of said first and second intermediate members including:

an L-shaped portion in which a part of a panel of a door or window is received;

a pad configured to be fit into at least one frame part; and an intermediate portion extended from the L-shaped portion to the pad, wherein the intermediate portion is integral with the L-shaped portion and the pad, wherein each of the L-shaped portion and the pad extend away from the intermediate portion in a first direction, and wherein at least one of the L-shaped portion and the pad comprise a flat face configured to receive a connector and facing only in a second direction opposite to the first direction; and the connector is received in respective faces of the first and second intermediate members for joining the first and second intermediate members together to form the intermediate element.

2. The intermediate element according to claim 1, wherein the pad and at least a first part of the intermediate portion are configured to fit within the at least one frame part, and wherein the L-shaped portion and at least a second part of the intermediate portion are configured to protrude from the at least one frame part, wherein the L-shaped portion comprises a at least one groove, and wherein the intermediate portion is extended from the L-shaped portion to the pad in a third direction that is substantially perpendicular to the second direction in which the at least one groove of the L-shaped portion is configured to receive the connector.

3. The intermediate element according to claim 2, wherein the L-shaped portion, the intermediate portion, and the pad are configured such that at least a portion of the at least one frame part is visible when the pad is fit to the at least one frame part and the part of the panel is fit to the L-shaped portion.

4. The intermediate element according to claim 2, further comprising:

wherein respective pads of the first and second intermediate members are joined to each other.

5. The intermediate element according to claim 4, wherein respective intermediate portions of the first and second intermediate members are configured to extend through a same opening between the at least one frame part when the respective pads of the first and second intermediate members are joined to each other.

6. The intermediate element according to claim 4, wherein respective L-shaped portions and respective second parts of the first and second intermediate members are configured to protrude from the at least one frame part.

7. The intermediate element according to claim 6, wherein the connector is extended between the respective L-shaped portions of the first and second intermediate members.

8. The intermediate element according to claim 7, further comprising:

a second connector;

wherein the connector is extended between grooves of the respective L-shaped portions, wherein the second connector is extended between grooves of the respective pads, wherein the connector and the second connector comprise a material different than a material of the respective L-shaped portions.

9. The intermediate element according to claim 7, wherein respective intermediate portions of the first and second intermediate members are spaced apart from each other.

10. The intermediate element according to claim 1, wherein the intermediate portion is extended from an end of an L-shape of the L-shaped portion to the pad, and wherein the L-shaped portion is extended, in the first direction and from the end of the L-shape, away from both of the intermediate portion and the connector.

11. An intermediate element comprising:

an L-shaped portion in which a part of a panel of a door or window is received;

a pad configured to be fit into at least one frame part;

an intermediate portion extended from the L-shaped portion to the pad;

another L-shaped portion configured to receive another part of the panel of the door or window;

another pad configured to be fit into at least one other frame part;

another intermediate portion extended from the other L-shaped portion to the other pad; and a connector, wherein the L-shaped portion is joined to the other L-shaped portion, and wherein the pad is joined to the another pad, wherein each of the L-shaped portion and the pad extend away from the intermediate portion in a first direction, and wherein at least one of the L-shaped portion and the pad comprise a flat face configured to receive the connector and facing only in a second direction opposite to the first direction.

12. The intermediate element according to claim 11, wherein the connector is extended from the L-shaped portion to the other L-shaped portion, wherein the L-shaped portion is joined to the other L-shaped portion by the connector.

13. The intermediate element according to claim 12, further comprising:

a second connector, wherein the connector is extended from a groove of the L-shaped portion to another groove of the other L-shaped portion, wherein the second connector is extended from a groove of the pad to another groove of the other pad, wherein the pad is joined to the other pad by the second connector, wherein the connector and the second connector comprise a material different than a material of the L-shaped portion, wherein the connector and the second connector each comprise a thermal resistance greater than that of the L-shaped portion.

14. The intermediate element according to claim 12, wherein the intermediate portion and the other intermediate portion are spaced apart from each other.

15. The intermediate element according to claim 13, wherein the connector is extended from the L-shaped portion to the other L-shaped portion in the second direction which is substantially perpendicular to a third direction in which the intermediate portion is extended from the L-shaped portion to the pad.

16. The intermediate element according to claim 11, wherein the pad and at least a first part of the intermediate portion are configured to fit within the at least one frame part, and wherein the L-shaped portion and at least a second part of the intermediate portion are configured to protrude from the at least one frame part.

17. The intermediate element according to claim 16, wherein the other pad and at least a first part of the other intermediate portion are configured to fit within the at least one other frame part, and wherein the other L-shaped portion and at least a second part of the other intermediate portion are configured to protrude from the at least one other frame part.

18. The intermediate element according to claim 11, wherein the intermediate portion and the other intermediate portion are configured to extend through a same opening between the at least one frame part and the at least one other frame part when the pad is fitted to the at least one frame part and the other pad is fitted to the at least one other frame part.

19. The intermediate element according to claim 11, wherein the L-shaped portion, the intermediate portion, the pad, the other L-shaped portion, the other intermediate portion, and the other pad are configured such that at least a portion of the at least one frame part and at least a portion of the at least one other frame part are visible depending on a position of the intermediate portion when the pad is fit to the at least one frame part, the part of the panel is fit to the L-shaped portion, the other pad is fit to the at least one other frame part, and the other part of the panel is fit to the other L-shaped portion.

20. An intermediate element comprising:

a first intermediate member and a second intermediate member, each of said first and second intermediate members including:

an L-shaped portion in which a part of a panel of a door or window is received;

a pad configured to be fit into at least one frame part; and an intermediate portion extended from the L-shaped portion to the pad, wherein the intermediate portion is integral with the L-shaped portion and the pad, wherein each of the L-shaped portion and the pad extend away from the intermediate portion in a first direction, wherein at least one of the L-shaped portion and the pad comprise a face configured to receive a connector and facing in a second direction opposite to the first direction; and the connector is received in respective faces of the first and second intermediate members for joining the first and second intermediate members together to form the intermediate element, wherein the pad and at least a first part of the intermediate portion are configured to fit within the at least one frame part, and wherein the L-shaped portion and at least a second part of the intermediate portion are configured to protrude from the at least one frame part, wherein the L-shaped portion comprises a at least one groove, wherein the intermediate portion is extended from the L-shaped portion to the pad in a third direction that is substantially perpendicular to the second direction in which the at least one groove of the L-shaped portion is configured to receive the connector, wherein respective pads of the first and second intermediate members are joined to each other, wherein respective intermediate portions of the first and second intermediate members are configured to extend through a same opening between the at least one frame part when the respective pads of the first and second intermediate members are joined to each other, wherein respective L-shaped portions and respective second parts of the first and second intermediate members are configured to protrude from the at least one frame part, wherein the connector is extended between the respective L-shaped portions of the first and second intermediate members wherein the intermediate element further comprises a second connector, wherein the connector is extended between grooves of the respective L-shaped portions, wherein the second connector is extended between grooves of the respective pads, and wherein the connector and the second connector comprise a material different than a material of the respective L-shaped portions.

* * * * *